United States Patent [19]

Brooks

[11] 4,121,442

[45] Oct. 24, 1978

[54] APPARATUS FOR RESTORING CRUSHED TUBES

[76] Inventor: Louis W. Brooks, 307 S. Kimball Ave., Caldwell, Id. 83605

[21] Appl. No.: 832,120

[22] Filed: Sep. 12, 1977

[51] Int. Cl.[2] ..... B21D 22/10

[52] U.S. Cl. ..... 72/54; 29/421 R

[58] Field of Search ..... 22/54, 58, 61; 29/421 R

[56] References Cited

U.S. PATENT DOCUMENTS

| | | | |
|---|---|---|---|
| 2,336,524 | 12/1943 | Bannister | 72/54 |
| 2,337,247 | 12/1943 | Kepler | 29/421 UX |
| 2,966,740 | 1/1961 | Macha | 29/421 |

*Primary Examiner*—Leon Gilden

*Attorney, Agent, or Firm*—Paul F. Horton

[57] ABSTRACT

Apparatus for taking dents, bends, and crushed areas out of siphon tubes and restoring the tubes to their original shape, the apparatus comprising a pair of end plugs, a pair of tube vises, a pair of screw clamps, and an hydraulic pump. The hydraulic pump has an inlet from a water source, such as a common garden hose, and an outlet to one of the end plugs. The end plugs each have an internal fluid passage for fluid communication with the interior of the tube to be restored. A second end plug is attached to the other end of the tube; the second plug terminating in a draincock for ridding the system of any air. The end plugs are held in sealed engagement with the ends of the tube to be restored by means of screw clamps which are anchored to the tube by means of the vises. To restore a crushed tube, water is allowed to fill the system through the inlet of the hydraulic pump. The draincock is then closed, sealing the system. Pressure is then applied to the interior of the crushed tube by means of the hydraulic pump until all dents and crushed areas are removed.

5 Claims, 8 Drawing Figures

APPARATUS FOR RESTORING CRUSHED TUBES

BACKGROUND OF THE INVENTION

1. Field of the Invention

This invention relates, in general, to the reshaping of hollow ductile objects, and in particular, to restoring crushed siphon tubes.

2. Description of the Prior Art

Siphon tubes, constructed of aluminum, are used extensively for irrigation purposes throughout the west, and to a lesser extent throughout the nation. Such tubes are also used in many foreign countries. The tubes, ordinarily constructed of ductile material, are frequently bent, dented or crushed in their daily use, often being damaged while being thrown to the ground, thrown into trucks, or being run over by vehicles. At present, there are no known devices for the practical restoration of such tubes. The tubes are therefore discarded at great cost to the farmer and, eventually, to the consumer.

Related prior art includes apparatus for straightening cans, of which the patent to J. J. Kirkby, U.S. Pat. No. 1,229,292 and the apparatus of Taylor, U.S. Pat. No. 2,254,250, is typical. C. E. Maier discloses method and apparatus for the explosive reshaping of hollow ductile objects. Such apparatus, is large and fixed in place, and generally requires molds for reforming the cans, and are not adaptable to varying sizes of tubes or cans, and are dangerous to use without appropriate shielding.

SUMMARY OF THE INVENTION

The present invention comprises, generally, a tube restoring device including a pair of end plugs having fluid passage to the tube, means for holding the plugs in place, and a hydraulic pump connectable to convenient water sources for pressure restoration of the tubes.

It is therefore an object of the present invention to provide tube restoring apparatus which is simple in construction, convenient to use, light in weight, and of practical significance.

More particularly, it is an object of the present invention to provide tube restoring apparatus utilizing a hand operated hydraulic pump and a pair of end plugs.

Even more specifically, it is an object of the present invention to provide tube restoring apparatus having end plugs adaptable to tubes of varying diameters.

It is also an object of the present invention to provide tube restoring apparatus conveniently used on tubes of varying shapes and lengths.

Additional objects and advantages will become apparent and a more thorough and comprehensive understanding may be had from the following description taken in conjunction with the accompanying drawings forming a part of this specification.

DETAILED DESCRIPTION OF THE INVENTION

Figure 1:
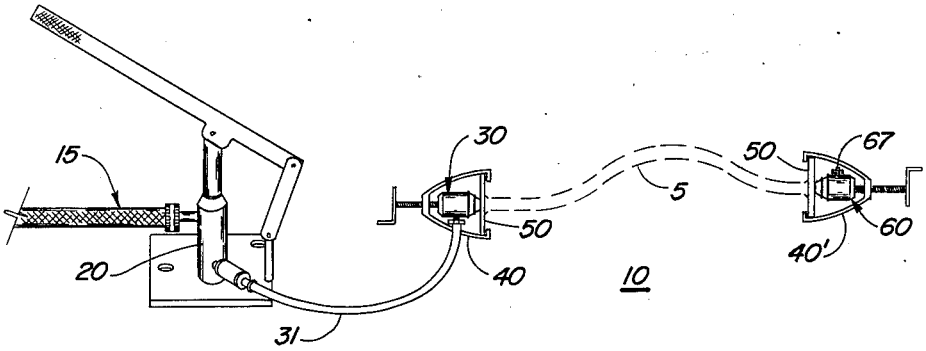
FIG. 1 is a schematic view of a preferred embodiment of the tube restoring apparatus of the present invention.

Referring now to the drawings, and, more particularly, to FIG. 1, an embodiment to be preferred of the tube restoring apparatus 10, made according to the present invention is disclosed. Tube restoring apparatus 10 includes a hydraulic pump 20, a first plug 30, a first clamp 40, a first vise 50, a second plug 60, a second clamp 40', and a second vise 50, as attached to a tube 5.

Figure 2:
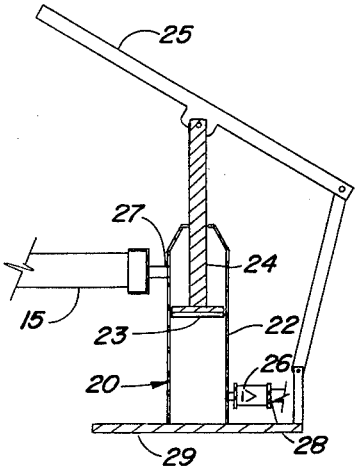
FIG. 2 is a cross sectional view of the hydraulic pump of the present invention.

Hydraulic pump 20, seen to advantage in FIG. 2, includes cylindrical housing 22 with an internal, reciprocating piston 23 attached by means of rod 24 to an exterior handle 25. Pump 20 also includes an intake port 27 and an outlet port 28. Pump 20 may also include a base plate 29 for stability. A check valve 26 is located adjacent the outlet port 28, and may be attached as a part of the pump itself, or may be included in conduit extending from outlet port 28. Port 27, in the preferred embodiment is attached to a common garden hose or other convenient source of water. Outlet port 28 is attached by conduit 31 to first plug 30, as shown in FIG. 1. It will be noted that the outlet port 28 is distal to the inlet port 27 so that piston 23 may be conveniently raised above the level of inlet port 27 so that water may flow freely through the pump. Upon pressing handle 25 downwardly, it will be seen that piston 23 forces any water contained in the cylinder to be ejected through outlet port 28 and through check valve 26. Because of the generally low pressure coming into inlet port 27, there is no need to turn off the water or disconnect the hose from the inlet. While a manually operated hydraulic pump is disclosed, and is preferred, it is understood that electrically operated pumps could also be used.

Figure 3:
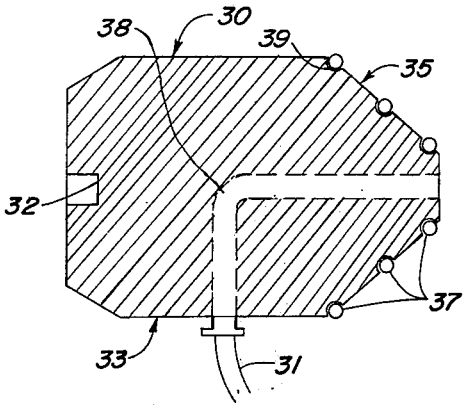
FIG. 3 is a sectional view of the first end plug of the present invention showing resilient O-rings on the conical surface.

First plug 30, shown to advantage in FIG. 3, is attached to hydraulic pump 20 by means of a high pressure hose 31. First plug 30 includes a substantially cylindrical portion designated by the numeral 33 and a conical portion designated by the numeral 35. It is contemplated that plug 30 will be of unitary construction except for O-rings 37, as will hereinafter be described. Plug 30 contains an internal fluid passage way, conduit 38. Conduit 38 extends through the plug having one terminal end adjacent to the apex of the conical portion and having its other terminal end extending through the side wall of cylindrical portion 33. Conical portion 35 of plug 30 contains a plurality of resilient O-rings 37 disposed within grooves 39 which are in spaced, parallel, relationship with one another on the cone surface. It is also contemplated that cone portion 35 could be constructed of, or contain on its outer surface, a resilient plastic material such as rubber or polyethylene.

Figure 4:
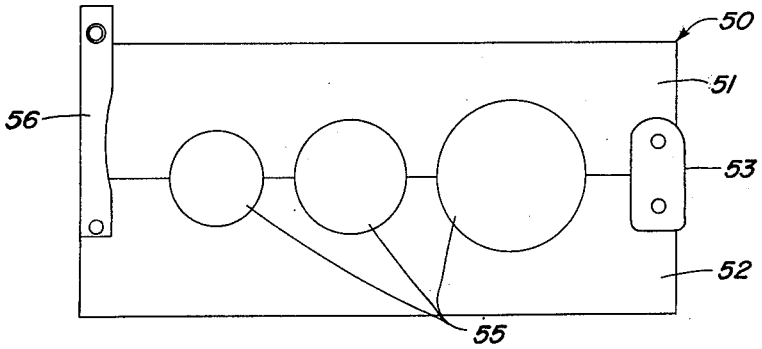
FIG. 4 is a front view of one of the vises of the present invention.

First plug 30 is held in place by means of screw clamp 40 in combination with first vise 50. First vise 50, as shown in FIG. 4, includes a pair of plates 51 and 52 pivotable on hinge 53, adjacent one end. The plates contain oppositely disposed semicircular openings which define a plurality of annular apertures 55 when in the closed position. Apertures 55 are of varying diameters, depending upon conventional siphon tube sizes.

Vise 50 also contains a closure latch 56 for locking the vise in a closed position. In operation, vise 50 is placed, in the open position adjacent the terminal edge of a siphon tube. The vise is then closed and latched, thereby clamping the siphon tube within a desired aperture 55. Once in place, vise 50 serves as an anchor for screw clamp 40 or 40'.

Figure 7:
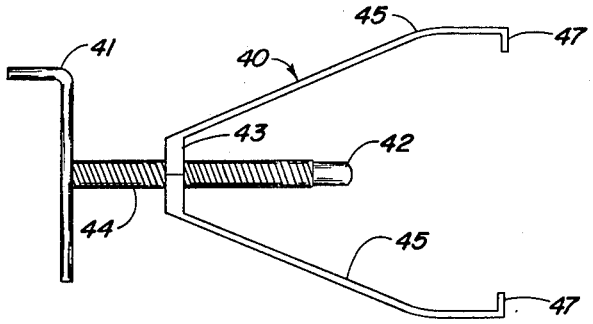
FIG. 7 is a screw clamp used in conjunction with the end plug of FIG. 5.

Screw clamp 40 as shown in FIG. 7 includes a central portion 43 having a threaded aperture, not shown, for receiving screw 44. Screw clamp 40 also includes a pair of oppositely disposed diverging arms 45 extending outwardly from central portion 43, the end of the arms containing a pair of flanges 47 for gripping vise 50 in similar manner as to that shown in FIG. 8. Screw 44 has attached at one end, a slightly conical cap portion 42 which mates with a centrally located counter sunk indentation 32 of lug 30. At the opposite end of the screw is handle 41 for tightening or loosening the clamp.

Figure 5:
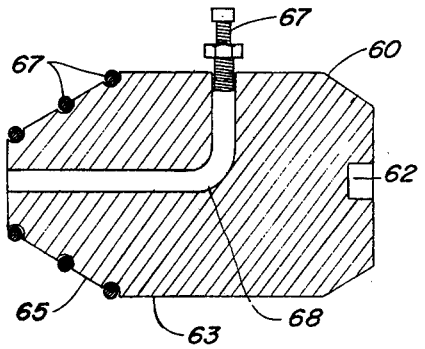
FIG. 5 is a sectional view of the second, i.e. distal, end plug of the present invention.
Figure 6:
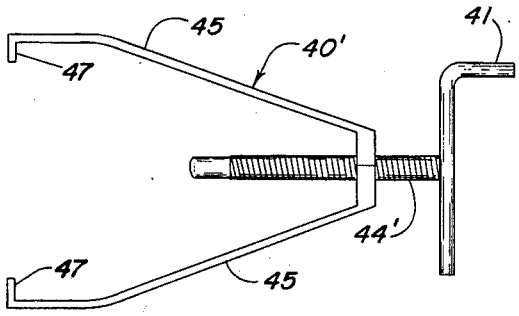
FIG. 6 is an elevated view of the screw clamp used in conjunction with the end plug of FIG. 5.

Second plug 60, shown in FIG. 5 is quite similar in construction to first plug 30 in regards to shape, internal passage way, and O-rings. Second plug 60 contains a counter sunk indentation 62 engageable with cap portion 42 of screw clamp 40'. Plug 60 differs from first plug 30 in that second plug 60 contains on its outer wall, in fluid communication with internal passage 68, drain cock 67, conventional in nature.

Figure 8:
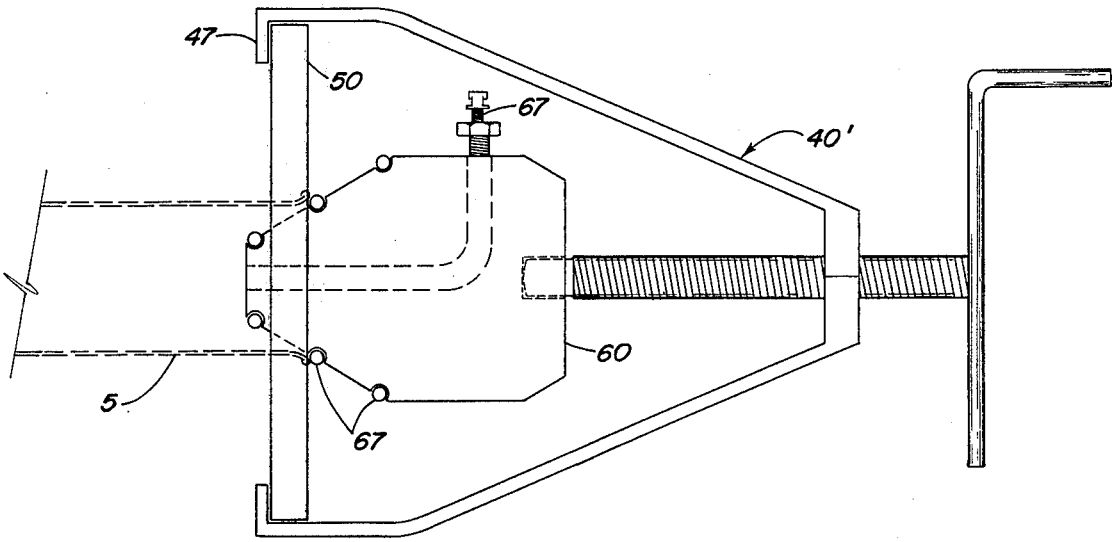
FIG. 8 is an elevated view of the distal end plug being held in place by means of a vise and screw clamp.

To restore a crushed tube, the following procedure is recommended. A vise 50 is clamped on each end of the tube adjacent the tube's ends. The external size of the tube will determine the apertures 55 to be used in attaching the vise. Plug 60 is then inserted into the distal end of the tube until the interior of the tube makes contact with O-rings 67 as shown in FIG. 8. Screw clamp 40' is clamped by means of flanges 47 over vise 50. Handle 41 of clamp 40' is then rotated to force plug 60 into a sealingly tight engagement with the crushed tube. In similar manner, plug 30 is inserted into the proximal end of the crushed tube. Screw clamp 40 is clamped onto second vise 50 and the head 42 of the screw clamp is brought into contact with the indentation 32 of plug 30. Handle 40 is then rotated to force plug 30 into tight engagement with the end of the tube, thus sealing the interior end of the tube against the O-rings of the plug. Plug 30 is then connected, preferably by conduit 31 to the outlet 28 of hydraulic pump 20. Inlet 27 of the hydraulic pump is next connected to a water source, such as common garden hose 15. Drain cock 67 is opened and pump handle 25 lifted to bring piston 23 above the inlet of intake port 27. It will be seen that, once water is supplied to the pump through hose 15, the water will proceed to fill cylinder 22 of the hydraulic pump and to fill conduit line 31, plug 30, portions of crushed tube 5, plug 60, and will finally exit through the open draincock 67. At this point, draincock 67 is closed and the operator lowers handle 25 of hydraulic pump 20 thereby forcing water through check valve 26 and outlet 28 into the crushed tube. The crushed portion and any other dents in the ductile material of tube 5 are forced outwardly into their normal position. The operator may pump the handle 25 a desired number of times to bring the tube back to its original configuration. It is to be understood that the tube restoring apparatus of the present invention does not straighten tubes, i.e., cause them to become linear in configuration, but rather restores them to their original configuration.

Having thus described in detail a preferred embodiment of the present invention, it is to be appreciated and will be apparent to those skilled in the art that many physical changes could be made in the apparatus without altering the inventive concepts and principles embodied therein. The present embodiment is therefore to be considered in all respects as illustrative and not restrictive, the scope of the invention being indicated by the appended claims rather than by the foregoing description, and all changes which come within the meaning and range of equivalency of the claims are therefore to be embraced therein.

I claim:

1. Crushed tube restoring apparatus comprising:

hydraulic pump means;

a first plug including a conical portion, the conical portion having resilient tube engaging means disposed on its outer surface operable to sealingly engage one end of a tube, said first plug including a conduit in fluid communication between said hydraulic pump means and the interior of the tube;

a second plug including a conical portion, the conical portion having resilient tube engaging means disposed on its outer surface operable to sealingly engage a second end of the tube, said second plug including a conduit in fluid communication with the interior of the tube; and a draincock in fluid communication with the conduit of said second plug, said draincock operable to close the conduit.

2. The apparatus as described in claim 1 wherein said hydraulic pump means includes:

a cylinder having an inlet adapted to connect with an external fluid source, and an outlet distal to said inlet, said outlet adapted to connect with said first plug;

a piston operable to reciprocate within said cylinder to force fluid from said inlet through said outlet; and a check valve adjacent said outlet to prevent fluid return to said cylinder.

3. The apparatus as described in claim 1, wherein said resilient tube engaging means of each plug comprises a plurality of cone encircling O-rings of gradually increasing diameters, extending adjacent the apex of the cone to the base of the cone in spaced, parallel, orientation.

4. The apparatus as described in claim 1 further comprising:

a pair of vises, each vise operable to securely engage the exterior of the tube adjacent opposing ends of the tube; and a pair of clamps, each of said clamps operable to engage one of said vises and one of said plugs for forcing the resilient tube engaging means of each plug into sealing engagement with respective ends of the tube.

5. Crushed tube restoring apparatus comprising:

a hydraulic pump including a cylinder having an inlet adapted to connect with an external water source, and an outlet distal to the inlet, a piston operable to reciprocate within the cylinder to force water from the inlet through the outlet, and a check valve adjacent the outlet to prevent water return from the outlet to the cylinder;

a first plug operable to sealingly engage one end of a tube, said plug having a conical portion, and a substantially cylindrical portion, the cylindrical portion secured to the conical portion adjacent its base, a fluid passage terminating at one end adjacent the apex of the conical portion and terminating at the other end through the side wall of the cylindrical portion, and a resilient tube-engaging means disposed on the exterior surface of the conical portion;

a first vise adapted to securedly engage the exterior terminal end of a tube;

a first screw clamp having a pair of arms for engaging said first vise and a central portion connecting the arms, the central portion in threaded engagement with a screw, the screw in contact with said first plug and operable to force said first plug into sealingly engagement with a terminal end of the tube;

a second plug operable to sealingly engage a second end of the tube, said plug having a conical portion and a cylindrical portion secured to the conical portion adjacent its base, a fluid passage terminating at one end adjacent the apex of the conical portion and terminating at the other end in a draincock on the side wall of the cylindrical portion, and said second plug having disposed on the exterior surface of the conical portion, a resilient tube-engaging means;

a second vise adapted to securedly engage a second exterior terminal end of a tube; and a second screw clamp having a pair of arms for engaging said first vise and a central portion connecting the arms, the central portion in threaded engagement with a screw, the screw in contact with said first plug and operable to force said first plug into sealingly engagement with a terminal end of the tube.

* * * * *